United States Patent [19]

Schefers et al.

[11] 4,423,994

[45] Jan. 3, 1984

[54] DRILLING RIG EQUIPPED WITH PAIRS OF BLOCK AND TACKLE SYSTEMS

[76] Inventors: Corby J. Schefers, 1112 B Chestnut St., Burbank, Calif. 91506; Louis D. Barber, 1156 Justin Ave., Glendale, both of Calif. 91201

[21] Appl. No.: 314,749

[22] Filed: Oct. 26, 1981

[51] Int. Cl.[3] ..... E21B 19/00

[52] U.S. Cl. ..... 414/22; 414/745; 175/85; 166/178; 254/285; 254/336; 254/415

[58] Field of Search ..... 414/22, 745, 910; 175/85, 52; 166/178; 254/398, 281, 284, 285, 326, 336, 337, 415; 212/194

[56] References Cited

U.S. PATENT DOCUMENTS

| | | | |
|---|---|---|---|
| 2,226,947 | 12/1940 | Sheldon | 414/22 |
| 2,643,005 | 6/1953 | De Jarnett | 414/22 |
| 3,658,298 | 4/1972 | Moore et al. | 414/22 X |
| 4,208,158 | 6/1980 | Davies et al. | 414/22 |

FOREIGN PATENT DOCUMENTS

| | | | |
|---|---|---|---|
| 642459 | 4/1964 | Belgium | 212/194 |
| 750793 | 6/1956 | United Kingdom | 414/667 |

*Primary Examiner*—Robert J. Spar
*Assistant Examiner*—Ken Muncy
*Attorney, Agent, or Firm*—Sellers and Brace

[57] ABSTRACT

This invention relates to drilling rigs, and more particularly to novel apparatus for supporting a plurality of pairs of block and tackle systems with the tackle systems of each pair operable sequentially and alternately, the one being used to support a main drilling or tubing string while the other is being used to rack stands of tubing therefrom.

34 Claims, 6 Drawing Figures

DRILLING RIG EQUIPPED WITH PAIRS OF BLOCK AND TACKLE SYSTEMS

BACKGROUND OF THE INVENTION

For many years drilling rigs have been equipped with a block and tackle system for use in conducting drilling operations including support of the drill string as well as for withdrawing it and for disassembly and reinserting it during reassembly. These assembly and disassembly operations are costly and time consuming operations when carried out by a single block and tackle because the tackle system cannot be reattached to the main drill string until completion of each racking cycle.

In recognition of this serious handicap, proposals have been made heretofore for speeding up a frill string servicing operation. Pertinent disclosures are to be found in the patents to Chappell U.S. Pat. No. 2,187,392; Sheldon U.S. Pat. No. 2,226,947; Wilkinson U.S. Pat. No. 2,954,131; Ashton U.S. Pat. No. 3,652,058 and Davies U.S. Pat. No. 4,208,158. Each shows separately operable block and tackle systems having some provision for shifting one of them into alignment with a well bore while the other is performing a racking operation. Only Wilkinson has any provision for changing the elevation of the tackle system crown blocks during their movement into and out of alignment with the well bore. However, the initial change in elevation relative to the large change laterally is likely to damage the threads of each detached stand. Additionally, prior proposals for utilizing pairs of tackle systems lack any provision for performing well bore servicing operations by a third block and tackle system specially designed for efficiency in conducting such operations. A further shortcoming of prior proposals is the lack of provision of multiple sets of block and tackle systems each usable in connection with a plurality of wells underlying a common drilling rig, or any means for utilizing a selected block of adjacent pairs of tackle systems to service an intervening well bore.

SUMMARY OF THE INVENTION

The shortcomings and disadvantages of prior efforts to provide drilling rigs with a pair of tackle systems each pair of which is usable in servicing one or more well bores are avoided by this invention. The achievement of these objectives is accomplished by providing the drilling rig with at least one and preferably a plurality of pairs of block and tackle systems having their respective crown blocks mounted on cranks rotatable simultaneously through arcs somewhat less than 180° overlying the crank axis. Each crown block of a pair is alternately positionable in alignment with the well bore and in a convenient racking position displaced substantially laterally of the well head. Stated differently, the tackle system engaged in a racking operation is located sufficiently away from the well head to provide safe operating conditions for the crew engaged in connecting the other tackle system to the drill string and to unthread a stand therefrom.

Each pair of cranks is equipped with its own hydraulic power system for rotating the cranks through overhead arcs of less than one half revolution. The initial part of this rotation is primarily upwardly to assure ample axial separation of the threads of a stand from the main string to avoid any possibility of thread damage. Subsequent portions of the crank cycle accellerates the lateral shifting of one tackle system away from the well bore as the other is accellerated into alignment therewith.

The framework supporting the pairs of cranks is also equipped with an auxiliary tool and cable system specially designed for various other service operations. This tool is shiftable into alignment with any one of the several well bores and its normally retracted cabling system can be lowered after an associated pair of cranks has been rotated to and locked in an upright position with each displaced laterally from the well bore. The ligher cabling system of the auxiliary tool includes its own power system and controls and can be connected to spudding, fishing and the like types of service tools.

Each of the cranks is preferably provided with clutching means for disengaging any selected crank from the common power drive for a pair of cranks. This permits the adjacent cranks of two pairs of cranks to service an additional well bore located therebetween. When so used, the second crank of each pair remains idle in a standby position remote from one another.

Accordingly, it is a primary object of this invention to provide a unique and improved drilling rig equipped with at least one pair of block and tackle systems operable to bodily raise and lower each tackle system sequentially and alternately into and out of alignment with a well bore.

Another object of the invention is the provision of a drilling rig having multiple pairs of block and tackle systems each servicing a separate well bore independently of the other with one tackle system usable for connection to the main string while the other is being used to rack a stand of detached tubing.

Another object of the invention is the provision of a drilling rig having a pair of tackle systems the crown blocks of which are mounted on separate cranks simultaneously rotatable through overhead acrs of less than one half revolution and including a power driven auxiliary cable system usable to perform a service operation when a pair of cranks is locked in an upright position.

Another object of the invention is the provision of a self contained unit mountable at the top of a drilling rig and having at least one pair of block and tackle systems the crown blocks of which are shiftable simultaneously upwardly and laterally relative to an underlying well bore.

These and other more specific objects will appear upon reading the following specification and claims and upon considering in connection therewith the attached drawing to which they relate.

Referring now to the drawing in which a preferred embodiment of the invention is illustrated:

Figure 1:
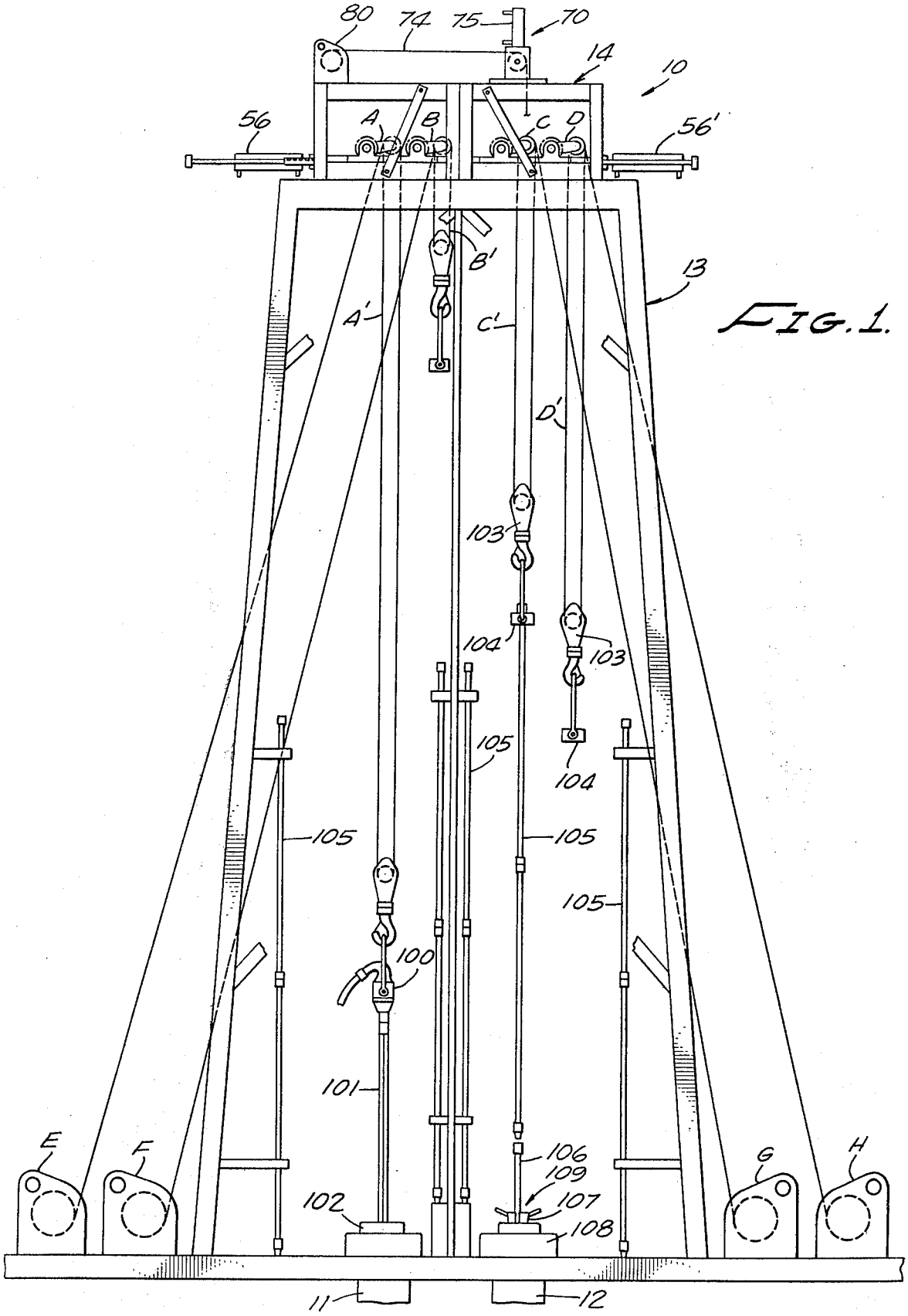
FIG. 1 is an elevational view of a drilling rig with portions of the derrick broken away and showing two well bores serviced by separate pairs of tackle and block systems.

Referring initially more particularly to 1, there is shown an illustrative embodiment of the improved drilling rig designated generally 10 overlying a pair of well bores 11, 12. The rig comprises a derrick 13 having a unitary frame 14 mounted across its top. Major portions of the trusses comprising main frame 14 have been omitted to avoid obscuring the principal components mounted thereon. Journalled crosswise of the lower portion of main frame 14 are two pairs of cranks including a first pair A, B and a second pair C, D. The bight portion of each supports the crown block of a respective block and tackle system A', B', C', D', the block and tackle systems A', B' are shown in position to serve well bore 11 and systems C', D' are positioned to serve well bore 12. The drilling line of each tackle system is connected to reeling drum of a respective draw-works E, F, G, H mounted on the drilling platform at the base of derrick 13. Although only two pairs of the cranks supporting a like number of block and tackle systems A', B', C', D', have been shown it will be understood that additional pairs may be accommodated in one or more rows parallel to those illustrated in FIG. 1.

Figure 3:
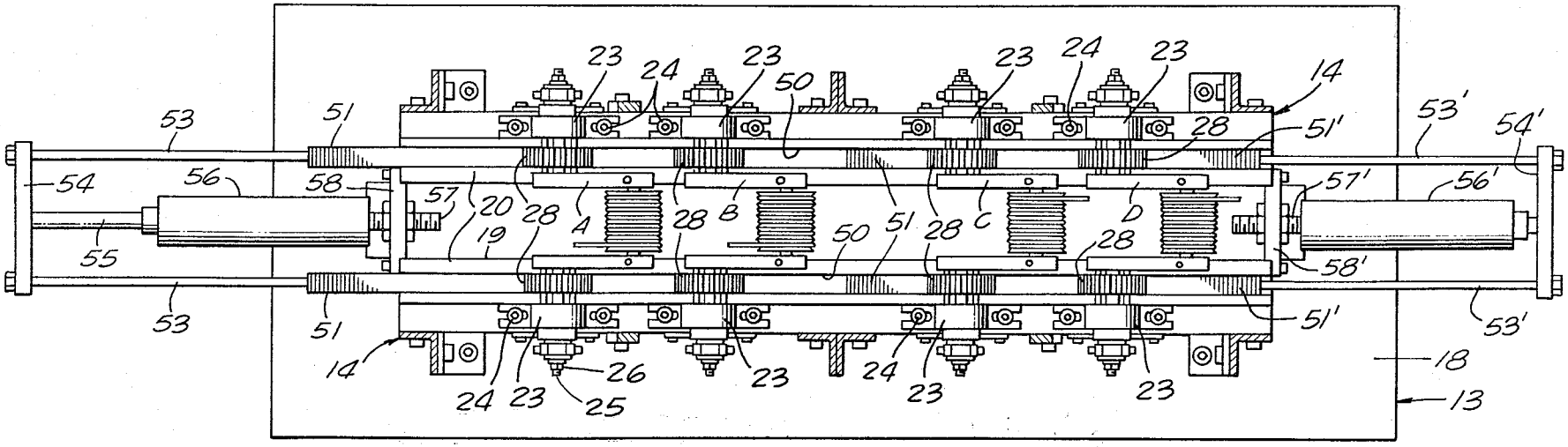
FIG. 3 is a cross sectional view taken along line 3—3 on FIG. 2.
Figure 4:
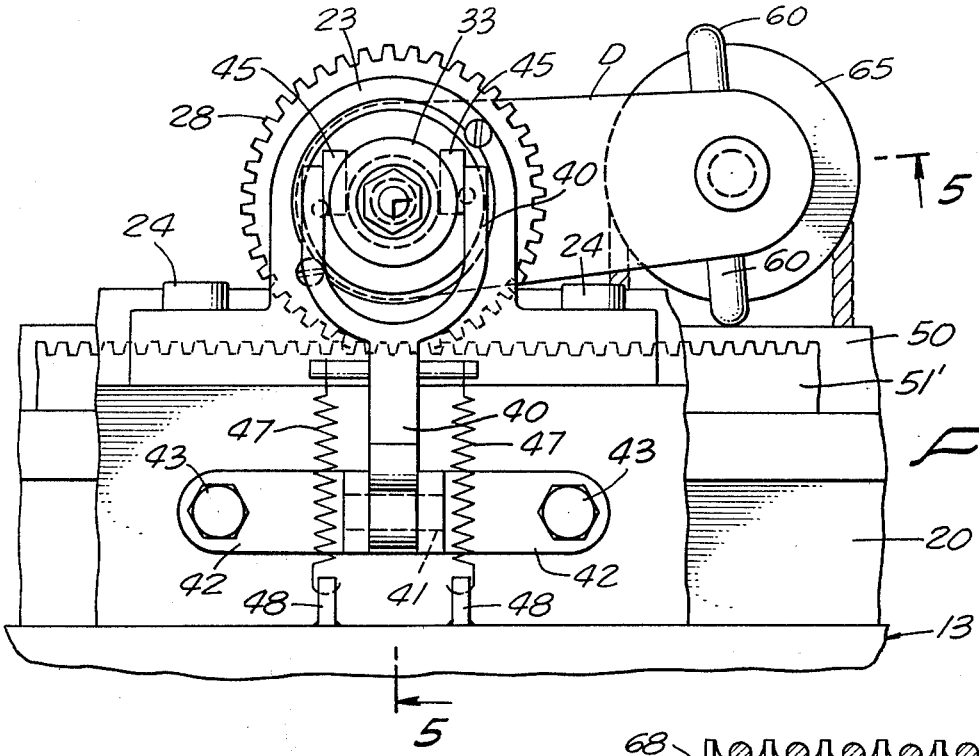
FIG. 4 is a fragmentary elevational view on an enlarged scale of the operating mechanism for a single one of the block and tackle crown blocks.
Figure 5:
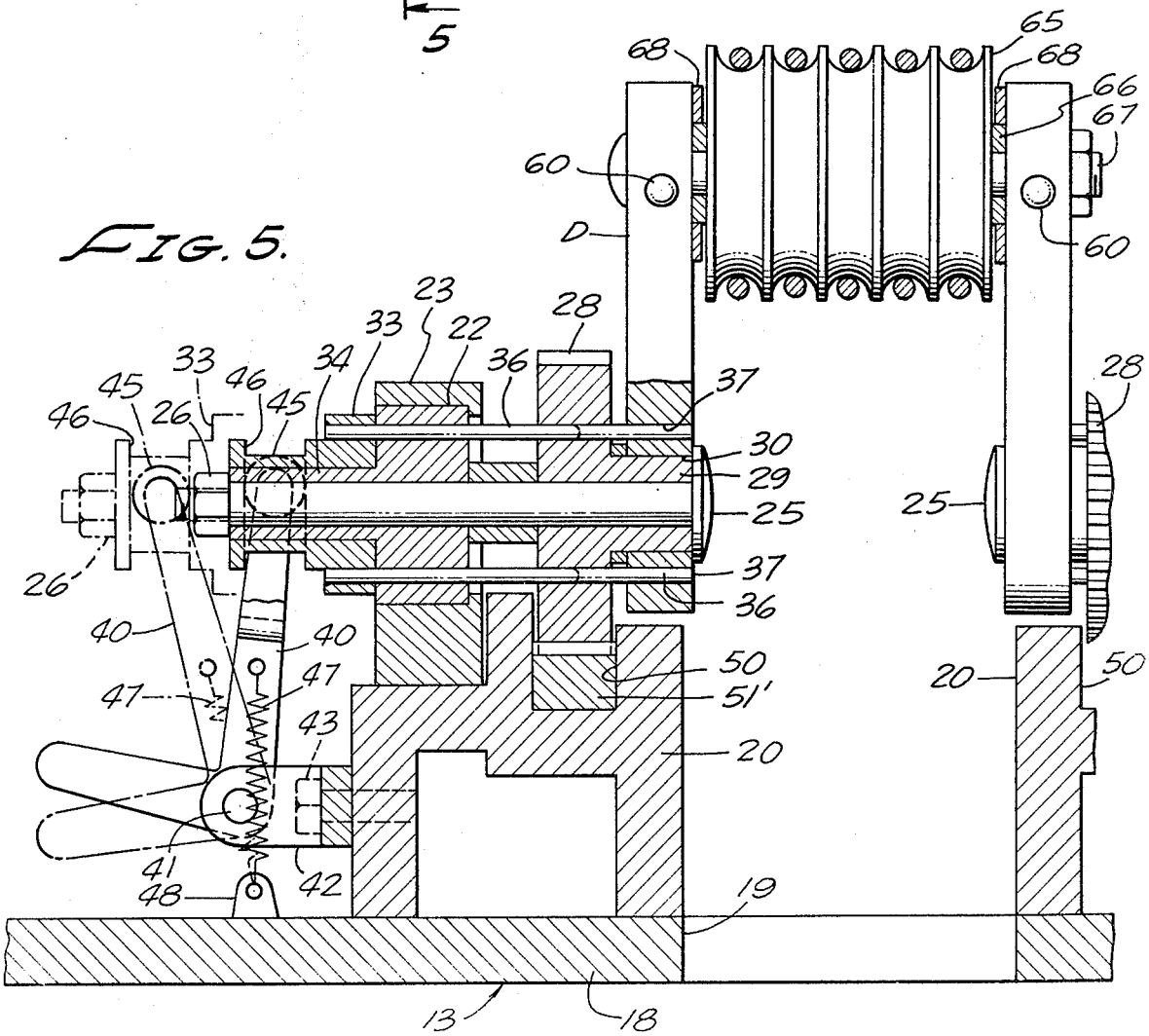
FIG. 5 is a cross sectional view taken along the broken line 5—5 on FIG. 4 showing the clutch engaged in full line and disengaged in the dot and dash line.

Referring now to FIGS. 2–5, it will be understood that the top of derrick 13 is provided with a platform 18 (FIG. 5) there shown as closed except for a rectangular slot 19 extending lengthwise of the central portion of main frame 14. Extending along either side of opening 19 and forming the base of frame 14 are a pair of contoured stringers 20, 20. The four cranks A to D straddle opening 19 as best appears from FIGS. 3 and 5. Each of the cranks is journalled on a pair of pillow blocks 23 secured to the underlying stringers 20, 20. Each of the pillow blocks includes a bearing 22 in which is journalled a crank shaft pin 25 provided with an assembly nut 26 at its other end (FIG. 5).

Also journalled on each of the crank pins 25 is a crank gear 28 having an integral hub 29 having a loose running fit in a bore 30 of the associated crank arm.

Desirably, and as herein shown, each of the cranks A to D is provided with a clutch for holding each of the gears 28 selectively coupled to the associated crank arm. This is accomplished by a clutch collar 33 loosely journalled on the outer end of hub 34 protruding axially from the pillow block bearing 22. Fixed immovably to clutch collar 33 are a pair of clutch pins 36 having a sliding fit in bores 37 extending through bearing 22, crank gears 28 and each of the crank arms A to D. Thus, when clutch collar 33 is positioned as shown in full lines in FIG. 5, clutch pins 36 extend fully into bores 37 of the crank arms and are thereby effective to hold crank gears 28 positively clutched to each of the adjacent ones of the crank arms. However, when clutch collar 33 is shifted to the left until the ends of pins 36 are clear of the bores 37 in the crank arms, these arms are free to pivot or rotate independently of cranks gears 28.

The clutches are shifted into and out of disengagement with the cranks by bell crank 40 mounted on a pivot pin 41 supported by brackets 42 secured to the outer sides of stringers 20 as by cap screws 43. The upper end of bell cranks 40 are bifurcated as best shown in FIG. 4 so as to straddle clutch collar 33. These arms are equipped with rollers 45 seated in a groove 46 encircling collar 33 and having rolling engagements with the sidewalls of groove 46. The clutch is preferably held in a selected one of its two stable positions by a toggle spring 47 connected between bell crank 40 and brackets 48. These springs are so positioned that their center lines lie to the right or left of the axis of pivot pins 41 in the respective stable positions of the clutch. When the center line lies to the right of this axis as shown in FIG. 5, the clutch is held engaged with the associated crank arm, whereas when it is positioned to the left side the axis pins 36 are withdrawn from the crank arm and gear 28 is disengaged or declutched from the crank arm.

It will be understood that, preferably, each of the cranks A to D includes a crank gear 28 associated with each of its arms and that each of these arms and its crank gear are provided with the clutch shown in FIGS. 4 and 5.

The drive means for rotating each pair of cranks when their clutches just described are engaged will now be described by reference to FIGS. 2 to 5. As shown in FIG. 5, each of the stringers 20, 20 supporting the pairs of cranks is provided with a groove 50 running the full length thereof directly beneath the crank gears 28. Slidably seated in each groove is a rack gear 51 having its teeth in mesh with a pair of adjacent crank gears 28. As herein shown, the gears 28 of cranks A and B are in mesh with rack 51 whereas the corresponding crank gears of cranks C and D are in mesh with the other pair of rack gears 51'. Each pair of rack gears 51, 51' is shifted lengthwise of grooves 50 by rods 53 secured to their outward ends of the rack gears and interconnected by a crossbar 54 the midportion of which is connected to a piston rod 55 of a double acting hydraulic cylinder 58. This cylinder is provided with a threaded rod 57 adjustably clamped to the midlength portion of a crossbar 58 secured to the outboard ends of stringer 20, 20.

The power operating means for the rack gears 51' is for cranks C and D and is similarly constructed and connected to the right hand end of stringers 20. Accordingly, the same reference characters have been employed to designate the same components but are distinguished by the application of a prime.

Figure 2:
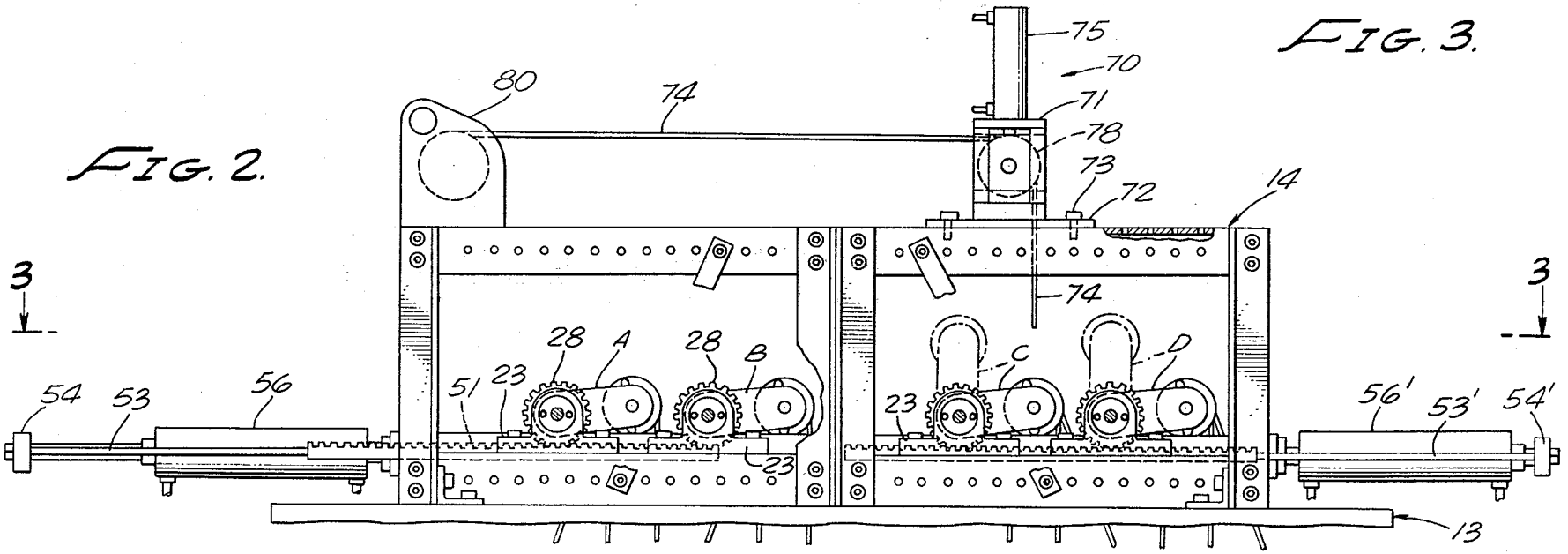
FIG. 2 is a side elevational view on an enlarged scale of the top portion of the drilling rig.

FIG. 2 shows the operating cylinder 56 fully extended outwardly with the result that rack gears 51 have rotated cranks A and B clockwise with the crown block of crank A overlying well bore 11. However, the right hand cylinder 56' is shown retracted with its rack gears 51' shifted fully to the left and its associated pair of cranks C and D rotated clockwise with the block and tackle C' overlying well bore 12. To be noted is the fact that each of the crank arms is preferably provided with a pair of stops, such as the stops 60, 60, positioned to engage the underlying portions of stringers 20 and support the crank arms tilted upwardly from a horizontal plane irrespective of whether the cranks lie in their left or right hand positions.

Referring now to FIGS. 4 and 5 it will be understood that the crown block 65 of each of the tackle systems is journalled on bearings embracing a sleeve 66 against the ends of which the crank arms are clamped by and through which the crown bolts 67 extend. As will be recognized by persons skilled in this art, the crown bolt 67 also functions as the crank pin of each of the cranks A to D. Spacer washers 68 are assembled about the sleeves and space the outermost sheaves of the crown block from the crank arms.

The block and tackle systems associated with cranks A to D are customarily employed for heavy duty drill rig operations including normal drilling as well as withdrawal and reinsertion of the drill string or the tubing string. Other service operations such as those associated with fishing, spudding, jarring and the like are more efficiently and effectively performed by a lighter faster acting auxiliary cabling equipment. These needs are satisfied by the auxiliary equipment now to be described by reference to FIGS. 1 and 2.

For these purposes there is provided atop main frame 14 a power unit designated generally 70 having a main frame 71 on a base plate 72 movable across the top of frame 14 with the vertical run of its cable 74 in alignment with any selected one of the well bores, such as 11 or 12. Once properly aligned, power unit 70 is anchored to the main frame as by bolts 73. A double acting cylinder 75 is secured in an upright position to the top of frame 71. Its piston rod 76 is operable to reciprocate a U-shaped slider 77 between the legs of which is journalled one or more sheaves 78 supporting cabling 74. Slider 77 is supported within guideways provided by main frame 71. The horizontal portion of cabling 74 is connected to a draw works 80 mounted either atop main frame 14 or at ground level adjacent derrick 13.

Figure 6:
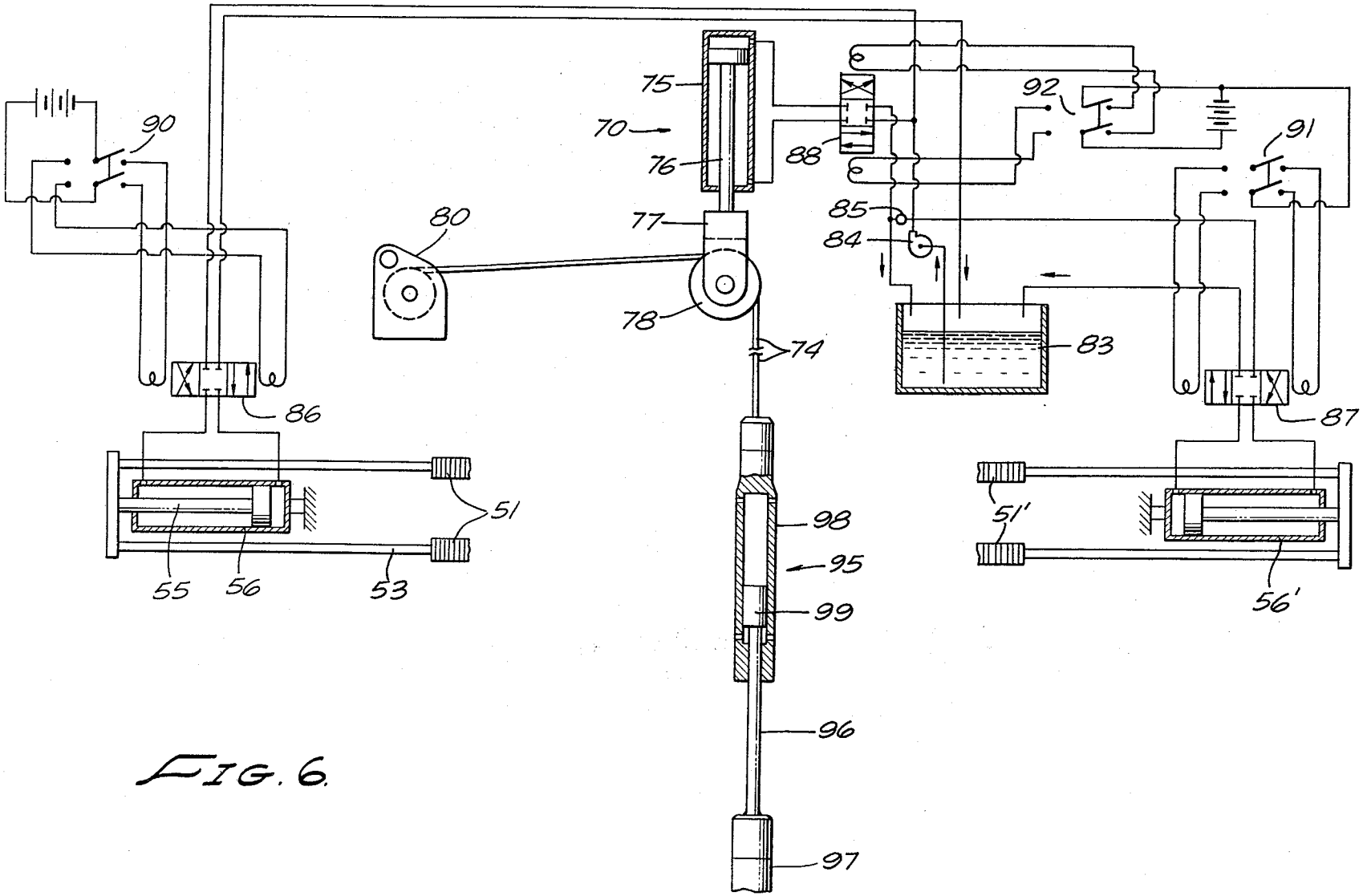
FIG. 6 is a schematic of the controls for the equipment at the top of the rig derrick.

Referring to FIG. 6, there is shown control means for supplying and controlling power to the cylinders 56, 56' for cranks A to D as well as to the auxiliary unit power cylinder 75. The controls and portions of the hydraulic system may be located at ground level but preferably are installed atop derrick 13 and include a reservoir 83 of hydraulic fluid connected to the inlet of a motor driven pump 84 having its outlet connected to solenoid controlled 4-way valves 86 and 87 controlling the operation of cylinders 56 and 56' and to a similar valve 88 controlling the double acting auxiliary unit cylinders 75. A pressure relief valve 85 interconnects the pump outlet and the fluid return line for purposes well known to those skilled in hydraulic systems. The power supply to the solenoids of valves 86 and 87 is controlled by separate double throw switches 90 and 91 whereas the power supply for valve 88 is controlled by a double throw switch 92. As shown, each of these valves is deenergized whereupon the associated spool centers itself to cut off all flow to or from either end of the associated cylinder. Accordingly, with the control switch in open position the cylinder is locked against movement in either direction.

As shown in FIG. 6, the power cylinder 75 for operating service tools is shown connected to a conventional jar tool 95 the lower end 96 of which is connected to the upper end of a drill string 97. In accordance with known practice, the elevation and lowering of its upper member 98 into abrupt engagement with the opposite ends of the slotted inner member 99 imparts powerful sharp blows in opposite directions to the drill stem, or selectively in one direction only at the operator's option, as appropriate, to release the string when stuck in a well bore. It will also be understood that the jar tool 95 may be replaced by fishing gear or other well known types of service tools customarily employed in well bores.

OPERATION

The versatility and economy to be enjoyed using the above described drilling rig and its equipment will be more fully appreciated following a description of typical modes of operation.

Referring to FIG. 1, the operating cylinders 56, 56' for the two pairs of cranks are positioned after having rotated pair A, B and pair C, D clockwise. Crank A is then positioned directly over well bore 11 with its block and tackle system A' supporting a drill string 101 via a Kelly 100. At this time tackle system B' is fully retracted because not needed.

The other pair of cranks C and D are shown in use to disassemble a drill string. At the moment there illustrated tackle system C' directly overlies well bore 12 and its travelling block 103 is engaged with a conventional elevator 104 in readiness to elevate a stand 105 of drill string which has been unthreaded from the main drill string 106. The latter is held rigidly suspended on the rotary drill table 108 by a conventional ring and slip device 107, 109. At this time tackle system D' has just been detached from a stand of tubing 105 already in one of the storage racks and is in readiness to be lowered. An operator having control of the double throw switch 91 for the 4-way valve 87 controlling cylinder 56' (FIG. 6) now closes this switch in the direction to shift valve 87 to the left to supply pressurized fluid to the left hand end of cylinder 56'. The piston of cylinder 56' then moves rightward to rotate the gears 28 of cranks C and D counterclockwise. These cranks along with the associated crown blocks are elevated to assure vertical separation of the threads of the detached stand 105 from the main string followed thereafter by simultaneous movement of both tackle systems laterally to the left, tackle system C' moving the detached stand laterally away from the wall and toward the racking storage cell generally centrally of the derrick, and tackle system D' shifting laterally into alignment with the well bore 12. Cranks C and D come to rest in their lowered counterclockwise positions where they are supported in an upwardly inclined position by stops 60. While elevator 104 is being detached from stand 105 the other tackle system D' is being lowered by the operator to draw works H for attachment of its elevator 104 to the top of the main string 106. The operating crew stationed on the well platform proceeds to attach the elevator whereupon the operator of draw works H raises the main string and the crew unscrews the next elevated stand from the main string. As these operations take place, the previous detached stand is being racked. Thereafter, switch 91 is thrown to the direction to shift the spool of valve 87 to the right to shift cylinder 56' to the right and rotate cranks C and D along with tackle systems C', D' back to the original position shown in FIG. 1, to start the next racking cycle.

Following withdrawal and servicing of the drill bit, the drill string is reassembled within the well bore by a reversal of the disassembly operations stands of the drill string being withdrawn alternately from the two racks to either side of well bore 12. Thereafter one of the tackle systems is utilized along with a Kelly and a square shank 101 extending through a rotary table 102 to drive the drill in resumed drilling operations.

If the drill string should become stuck in the well bore during either a withdrawal or a reassembly operation, the auxiliary service unit 70 is brought into service. As shown in FIGS. 1 and 2, auxiliary unit 70 is shown with its cabling 74 in vertical alignment with well bore 12. However, if the unit has been previously utilized over well bore 11 then its anchor bolts 73 are removed and tool 70 is shifted from bore 11 to bore 12 following which its anchor bolts 73 are reassembled to main frame 14. The tool may be moved along the top of main frame 14 by a tackle block not shown, by a hydraulic cylinder, or by a nut and screw mechanism all of which are well known to those skilled in this art. It will be understood that the double acting cylinder 75 is connected to four way valve 88 by flexible hoses and that the remainder of the hydraulic and control system is preferably mounted on main frame 14. However, the control switches 90, 91 and 92 may be located either at the top of the base of derrick 13.

Before proceeding to use auxiliary unit 70 the operator closes switch 91 controlling 4-way valve 87 to admit fluid to cylinder 56' so as to rotate cranks C and D to an upright position midway between the two normal operating positions. When cranks C and D are locked in their upright positions, as is indicated in dot and dash lines in FIG. 2, the block and tackle system C', D' are positioned to either lateral side of well bore 12. This leaves the intervening space between the two cranks clear and unobstructed for the lowering of the auxiliary tool cabling 74. Its draw works 80 may then be operated to lower cabling 74 for attachment to a jar tool 95 (FIG. 6). The lower end 96 of the latter is then attached to the upper end of the stuck drill string 97. This having been completed, the operator closes the double throw switch 92 intermittently in first one direction and then the other to admit fluid to first one end and then the other of cylinder 75 as other fluid is drained from the opposite end back to reservoir 83. In this manner the U-shaped slider 75 supporting sheave or sheaves 78 first raises the jar tool 95 to one extreme and then allows it to drop suddenly and abruptly against the other extreme until the drill string is freed.

At other times, a well bore service tool may become detached from its support thereby necessitating the conduct of fishing operations to locate the detached component. The auxilliary tool 70 is moved if necessary into alignment with the troubled well bore and utilized along with a fishing tool connected to cabling 74 to recover the detached component. An appropriate one of cylinders 56 or 56' is used as previously to rotate the adjacent pair of cranks to an upright position whereupon the associated control switch 90 or 91 is opened thereby restoring the spool of the related 4-way valve to its center or neutral position to lock cylinder 56 or 56' against movement in either direction.

It will also be understood that the presence of clutches between each of the gears 28 and the adjacent arm of cranks A to D enables the operator to drill and perform servicing operations on a third well located between well bores 11 and 12. This is done in the following manner.

Assuming that each of the cranks is positioned as shown in FIGS. 2 and 3, the operator proceeds by utilizing cylinder 56 to rotate cranks A and B to their counterclockwise positions. The operator then operates each of the clutch levers 40 to disengage the crank gears 28 from the arms of cranks A and D. The clutch pins 36 for each arm of these two cranks are then withdrawn from their associated crank arms to the dot and dash position illustrated in FIG. 5. Cylinders 56 and 56' may now be operated to drive the respective pairs of rack gears 51 and 51' to rotate cranks B and C. Desirably, these cranks should be operated in unison in the same direction by simultaneously closing their associated switches 90 and 91 either to the right or to the left. Cranks A and B now remain inactive since the clutches of their crank gears 28 are declutched from rack gears 51 and 51'. By these simple expedients the operator is able to drill and service a third well, not shown but generally centrally between the axes of cranks C and D.

While the particular drilling rig equipped with pairs of block and tackle systems herein shown and disclosed in detail is fully capable of attaining the objects and providing the advantage hereinbefore stated, it is to be understood that it is merely illustrative of the presently preferred embodiment of the invention and that no limitations are intended to the detail of construction or design herein shown other than as defined in the appended claims.

We claim:

1. That improvement in a drilling rig having a tower equipped at its top with equipment support means which comprises:

a pair of spaced apart cranks mounted on stationary support means for pivotal movement solely in respective coplanar arcs overlying a horizontal plane through the pivot axes of said cranks;

a separate block and tackle means having the crown blocks thereof journalled on a respective crank pin of said cranks; and power means operatively connected to said cranks for pivoting the same in the same direction in unison through respective arcs overlying said horizontal plane and between first and second operating positions of said block and tackle means located on the opposite sides of a respective vertical plane through the pivot axis of a respective one of said cranks.

2. That improvement in a drilling rig defined in claim 1 characterized in that the pivot axes of said pair of cranks are located generally equidistantly from the opposite sides of a well bore and such that when one of said crown blocks overlies said well bore the other one thereof is spaced laterally to one side of said well bore.

3. That improvement in a drilling rig defined in claim 2 characterized in the provision of a racking facility for storing a stand of tubing and/or of drill stem being serviced by a respective one of said block and tackle means when positioned laterally to one side of said well bore.

4. That improvement in a drilling rig defined in claim 1 characterized in that said power means for operating said cranks is operable to rotate said cranks to a selected intermediate position parallel to one another and to hold the same immovably in said intermediate position.

5. That improvement in a drilling rig defined in claim 4 characterized in the provision of power means at the top of said tower including cabling connectable to a well service tool, such as a jar tool, a fishing tool and the like, and including means for manipulating said cabling and a well servicing tool connected thereto while said cranks are held immovably in said intermediate position to either side of said cabling.

6. That improvement in a drilling rig defined in claim 5 characterized in that said power means comprises hydraulically powered means operable to alternately elevate and drop said cabling bodily while said cabling is connected to a well bore servicing tool.

7. That improvement in a drilling rig defined in claim 1 characterized in that said power means for pivoting said pair of cranks in unison includes rack gear means in mesh with gear teeth fixed to each of said cranks and concentric with the pivot axes thereof.

8. That improvement in a drilling rig defined in claim 1 characterized in the provision of stop means for limiting the clockwise and counterclockwise pivoting movement of said cranks.

9. That improvement in a drilling rig which comprises:

a main frame mounted non-rotatably adjacent the top of a drilling rig derrick;

a pair of generally similar cranks having parallel shaft means journalled on said main frame each supporting on the crank pin thereof the crown block of a respective block and tackle system, the axes of said crank shaft means being spaced apart horizontally by approximately double the distance between the axis of the crank shaft means and the axis of the crank pin thereof; and means for rotating each of said cranks through respective arcs overlying the axes of said crank shaft means thereby to transfer a respective one of said block and tackle systems between the opposite lateral sides of the associated one of said crank shaft means.

10. That improvement defined in claim 9 characterized in the provision of stop means for each of said cranks to limit the rotary movement thereof such that the axes of said crank pins are always spaced vertically above a horizontal plane through the axis of the associated one of said crank shaft means.

11. That improvement defined in claim 10 characterized in that said stop means include means are carried by the opposite lateral edges of crank arms interconnecting said crank shaft means and said crank pin.

12. That improvement defined in claim 9 characterized in the provision of means for rotating said pair of cranks in unison and in the same direction about the axis of their respective crank shaft means.

13. That improvement defined in claim 9 characterized in that said means for rotating said cranks includes driven gear means mounted coaxially of each of said crank shaft means and in mesh with driver gear means.

14. That improvement defined in claim 13 characterized in that said driver gear means comprises power-reciprocable rack gear means in mesh with the driven gear means of each of said cranks.

15. That improvement defined in claim 9 characterized in that said means for rotating each of said cranks includes reversible hydraulic means.

16. That improvement defined in claim 9 characterized in that said means for rotating said crank means includes means for deactivating the drive to at least one of said cranks while maintaining the drive to the other of said cranks.

17. That improvement defined in claim 9 characterized in the provision of separate independent draw works connected to a respective one of said block and tackle systems whereby said block and tackle systems are operable sequentially to rack a section of drill stem and to elevate the main drill stem, and whereby one of said block and tackle systems can be retracted upwardly while the other is being extended downwardly.

18. That improvement defined in claim 9 characterized in the provision of a plurality of pairs of said cranks each supporting a block and tackle system connected to an associated draw works and operable to service a respective drill stem for separate well bores located midway between the crank shaft axes of a respective pair of said cranks.

19. That improvement defined in claim 18 characterized in that said pairs of cranks are arranged in a row on said main frame with the axes thereof parallel to one another, and power means for rotating said cranks through respective arcs overlying a horizontal plane through the axis of said cranks to shift said block and tackle systems between the opposite sides of the axes of said cranks.

20. That improvement defined in claim 19 characterized in that the cranks of each pair thereof are rotatable on respective axes located equidistantly from the opposite sides of a drill stem to be serviced by respective pairs of said cranks.

21. That improvement defined in claim 20 characterized in that the crank shaft means of at least one crank of each pair thereof is equipped with normally closed disengageable coupling means for connecting said one crank to a power drive for said pairs of cranks.

22. That improvement defined in claim 20 characterized in that said power means includes separate hydraulically powered means operatively connected to a respective pair of said cranks for rotating a respective pair of said cranks through less than one half a revolution between stationary rest positions on the opposite sides of the pivot axes of said cranks.

23. That improvement defined in claim 18 characterized in the provision of means on said main frame overlying a well bore midway between the pivot axes of a pair of said cranks for performing a service operation, said sevice operation means comprising cabling and supporting sheave means therefor, and power means operable while said cranks are at rest for reciprocating said sheave means in a limited vertical path to operate a service tool attached to said cabling.

24. That improvement defined in claim 23 characterized in that said power means for said sheave means comprises a double action hydraulic piston means.

25. That improvement defined in claim 23 characterized in that said sheave is selectively positionable above a well bore serviced by any one of said plurality of cranks.

26. That improvement in a well bore drilling rig which comprises:

a main frame fixedly secured to the top of a derrick for said well bore;

a pair of spaced apart block and tackle systems suspended from said main frame for use in servicing tubing stands of a well bore and including power driven means for simultaneously bodily raising and then simultaneously lowering said block and tackle systems, including the crown blocks thereof, while shifting one thereof laterally toward a well bore and the other laterally away from a well bore whereby one of said systems is available for attachment to a main tubing string.

27. That improvement in a drilling rig defined in claim 26 characterized in the provision of a plurality of pairs of said block and tackle systems arranged in a row on said main frame operable independently of one another to service a tubing string of a respective underlying well bore.

28. That improvement in a drilling rig as defined in claim 26 characterized in that said power driven means includes normally engaged coupling means including means for disengaging the same to deactivate the means for shifting at least one of said block and tackle systems to an idle position displaced laterally away from the well bore and leaving the other of said systems available for use.

29. That improvement in a drilling rig defined in claim 26 characterized in that said power driven means includes normally engaged coupling means selectively operable to deactivate the means for laterally shifting either one of said block and tackle systems relative to the well bore while leaving the other of said systems available for use.

30. In a drilling rig having a derrick and a pair of draw works for a respective pair of block and tackle systems that improvement which comprises:

a main frame mounted adjacent the top of said derrick;

a pair of cranks journalled on said main frame each supporting the crown block of a respective one of said block and tackle systems; and power means for rotating said cranks to position one of said block and tackle means over a well bore midway between the journals of said cranks while the other one thereof is displaced laterally away from said well bore.

31. A drilling rig as defined in claim 29 characterized in that said power means includes coupling means for each of said cranks operable when engaged to rotate said cranks in unison in the same direction in an arc overlying said journals between respective stop positions with one of said block and tackle systems overlying said well bore and the other one thereof adjacent a tubing racking station.

32. A drilling rig as defined in claim 31 characterized in that said power means includes reciprocable rack gear means in mesh with gear means for each of said cranks, and said coupling means being selectively operable to connect or disconnect said gear means to and from a respective one of said cranks.

33. A drilling rig as defined in claim 26 characterized in that said power means for simultaneously raising and lowering said pair of block and tackle systems is operable to lock said block and tackle systems in an elevated position and respectively spaced laterally away from the well bore.

34. A drilling rig as defined in claim 33 characterized in the provision on said main frame of power means overlying said well bore and operable when said pair of block and tackle systems are locked in said elevated position to perform a well bore service operation.

* * * * *